US006699008B2

(12) United States Patent
Japikse

(10) Patent No.: US 6,699,008 B2
(45) Date of Patent: Mar. 2, 2004

(54) FLOW STABILIZING DEVICE

(75) Inventor: David Japikse, Norwich, VT (US)

(73) Assignee: Concepts ETI, Inc., White River Junction, VT (US)

( * ) Notice: Subject to any disclaimer, the term of this patent is extended or adjusted under 35 U.S.C. 154(b) by 0 days.

(21) Appl. No.: 10/172,886

(22) Filed: Jun. 17, 2002

(65) Prior Publication Data

US 2002/0192073 A1 Dec. 19, 2002

Related U.S. Application Data

(60) Provisional application No. 60/298,843, filed on Jun. 15, 2001.

(51) Int. Cl.[7] ..... F04D 29/44

(52) U.S. Cl. ..... 415/58.4; 415/58.5; 415/144; 415/244.5; 415/914

(58) Field of Search ..... 415/58.4, 58.5, 415/144, 168.1, 224.5, 914

(56) References Cited

U.S. PATENT DOCUMENTS

| | | | | |
|---|---|---|---|---|
| 1,111,498 | A | 9/1914 | Rotter | |
| 2,342,219 | A | 2/1944 | Price | 230/114 |
| 2,405,282 | A | 8/1946 | Birmann | 230/47 |
| 2,656,096 | A | 10/1953 | Schwartz | 230/116 |
| 2,658,338 | A | 11/1953 | Leduc | 60/39.36 |
| 2,698,711 | A | 1/1955 | Newcomb | 230/114 |
| 2,704,516 | A | 3/1955 | Mock et al. | 103/88 |
| 2,709,917 | A | 6/1955 | Bruynes | 73/147 |
| 2,786,420 | A | 3/1957 | Kenney | 103/97 |
| 2,832,292 | A | 4/1958 | Edwards | 103/87 |
| 2,837,270 | A | 6/1958 | Chapman | 230/115 |
| 2,865,297 | A | 12/1958 | Cliborn et al. | 103/103 |
| 2,874,642 | A | 2/1959 | Forrest | 103/97 |
| 2,966,028 | A | 12/1960 | Johnson et al. | 60/35.6 |
| 3,070,025 | A | 12/1962 | Cliborn | 103/97 |

(List continued on next page.)

FOREIGN PATENT DOCUMENTS

| | | |
|---|---|---|
| EP | 0399343 B1 | 4/1994 |
| JP | 09032722 A | 2/1997 |

OTHER PUBLICATIONS

"Control of Backflow at the Inlets of Centrifugal Pumps and Inducers," by Donald P. Sloteman, Paul Cooper and Jules L. Dussourd, *Proceedings of the First International Pumps Symposium*, Texas A&M University College Station, Texas, May 1984, pp. 9–22.

"Model 250–C30/C28B Compressor Development," by Dennis C. Chapman, General Motors Corporation (no date).

*Primary Examiner*—Ninh H. Nguyen
(74) *Attorney, Agent, or Firm*—Downs Rachlin Martin PLLC

(57) ABSTRACT

The present invention is a device (100) for at least partially stabilizing an unstable fluid flow within a flow channel (103) by capturing at least a portion of the unstable fluid within a vaneless diffuser having a diffuser slot (104). The present invention also includes maintaining and harnessing a substantial portion of the energy contained in the fluid as it flows through the diffuser in order to utilize the fluid to improve the condition of the flow field. An example of a beneficial use includes discharging the diffuser effluent into the flow at other points critical to instability, hence reducing the overall instability of the flow channel.

38 Claims, 4 Drawing Sheets

U.S. PATENT DOCUMENTS

| | | | | | |
|---|---|---|---|---|---|
| 3,090,321 | A | | 5/1963 | Edwards | 103/113 |
| 3,106,165 | A | | 10/1963 | Tyler | 103/97 |
| 3,123,285 | A | | 3/1964 | Lee | 230/133 |
| 3,163,119 | A | | 12/1964 | Huppert et al. | 103/89 |
| 3,217,655 | A | | 11/1965 | Sercy et al. | 103/103 |
| 3,240,012 | A | | 3/1966 | Price | 60/39.23 |
| 3,325,089 | A | | 6/1967 | Vogler | 230/125 |
| 3,426,964 | A | | 2/1969 | Silvern | 230/114 |
| 3,462,071 | A | | 8/1969 | Garve | 230/114 |
| 3,484,039 | A | | 12/1969 | Mittelstaedt | 230/122 |
| 3,504,986 | A | | 4/1970 | Jackson | 415/11 |
| 3,730,639 | A | | 5/1973 | Moore et al. | 415/119 |
| 3,741,677 | A | | 6/1973 | Silvern et al. | 415/52 |
| 3,887,295 | A | | 6/1975 | Yu | 415/116 |
| 3,893,787 | A | | 7/1975 | Jones | 415/213 |
| 3,901,620 | A | | 8/1975 | Boyce | 415/1 |
| 3,993,414 | A | | 11/1976 | Meauze et al. | 415/181 |
| 4,063,848 | A | | 12/1977 | Wiggins et al. | 415/206 |
| 4,097,186 | A | | 6/1978 | Budris | 415/143 |
| 4,116,171 | A | | 9/1978 | Schulmeister et al. | 123/41.57 |
| 4,142,839 | A | | 3/1979 | Davis et al. | 417/89 |
| 4,212,585 | A | | 7/1980 | Swarden et al. | 415/53 |
| 4,239,453 | A | | 12/1980 | Hergt et al. | 415/182 |
| 4,248,566 | A | | 2/1981 | Chapman et al. | 415/26 |
| 4,375,937 | A | | 3/1983 | Cooper | 415/53 |
| 4,375,938 | A | | 3/1983 | Dussourd | 415/53 |
| 4,642,023 | A | | 2/1987 | Dunn | 415/53 |
| 4,673,331 | A | | 6/1987 | Kolb | 415/53 |
| 4,678,405 | A | | 7/1987 | Allen | 417/245 |
| 4,708,584 | A | | 11/1987 | Meng | 415/53 |
| 4,720,242 | A | | 1/1988 | Lovisetto | 416/186 |
| 4,743,161 | A | | 5/1988 | Fisher et al. | 415/53 |
| 4,781,530 | A | | 11/1988 | Lauterbach et al. | 415/170 |
| 4,815,935 | A | | 3/1989 | Gottemoller | 415/211 |
| 4,834,611 | A | | 5/1989 | Meng | 415/58.5 |
| 4,930,978 | A | * | 6/1990 | Khanna et al. | 415/58.3 |
| 4,981,018 | A | * | 1/1991 | Jones et al. | 60/726 |
| 4,990,053 | A | * | 2/1991 | Rohne | 415/58.4 |
| 5,147,178 | A | | 9/1992 | Treece | 415/58.4 |
| 5,186,601 | A | * | 2/1993 | Treece et al. | 415/58.4 |
| 5,286,162 | A | | 2/1994 | Veres | 415/115 |
| 5,545,014 | A | | 8/1996 | Sundberg et al. | 417/204 |

* cited by examiner

FLOW STABILIZING DEVICE

RELATED APPLICATION DATA

This application claims the benefit of U.S. Provisional Patent Application No. 60/298,843, filed Jun. 15, 2001, which is incorporated by reference as if included herein in its entirety.

FIELD OF THE INVENTION

The present invention relates to a device for at least partially stabilizing vortex or other unstable flow in a flow channel, and in particular to a substantially radial, vaneless diffuser defined by an annular slot in the sidewalls of the flow channel.

BACKGROUND OF THE INVENTION

The use of a diffuser to reduce the velocity and increase the static pressure of a fluid passing through a system is well known. As a fluid flow enters a diffuser, kinetic energy in the fluid is converted to a static pressure rise due to conservation of angular momentum when swirl is present and conservation of linear momentum. Diffusers are often used in combination with a bladed impeller or combined inducer/impeller within a particular system.

Bladed impellers or combined inducer/impellers are the key component of centrifugal, mixed flow, and axial pumps, compressors, blowers, and fans to move various fluids (i.e., air, water, vapor, or combination thereof) through a system. Depending on the condition of the fluid flow as it approaches the inlet to the equipment, the design of bladed impellers or combined inducer/impellers may be critical to control instability in the fluid flow and prevent instability in the equipment overall and to control other fluid problems such as non-collateral boundary layers. Examples of instabilities in fluid flow include vortices (in any type of fluid) often created from the impeller/inducer design itself, cavitating flow in liquids caused by vortices in the fluid, or a combination thereof, and boundary layer flows which are not collateral with the main flow direction.

In the case of conventional pumps, bladed impellers or combined inducer/impellers are typically used to deal with very low inlet pressure conditions. As the fluid passes through the bladed section, it experiences a rise in pressure. In the case of a cavitating liquid/vapor flow, the increase in pressure may cause the vapor bubbles in the flow to collapse and/or condense thereby causing the fluid to transfer from a vapor phase back to a liquid phase. For certain applications, this is extremely critical. Turbopumps, aircraft fuel pumps, and many industrial pumps are concerned with very low inlet pressure conditions.

An unfortunate aspect of inducer performance is that the cavitating flow cannot be completely prevented under various operating conditions. Performance remains constant down to a very low inlet pressure, but with sufficient reduction in the inlet pressure a complete breakdown in head results. This typically occurs when cavitated (two-phase) flow, originating principally from a part-span or tip vortex, substantially fills the impeller passages. These instabilities result from the development of cavitating flow in the inducer. If this developing flow is unable to maintain a consistent, uniform, and steady flow pattern within the inducer, oscillations result. These oscillations can be serious, leading to auto-oscillation where a dynamic instability exists in the impeller and begins to propagate instabilities into the entire pumping network and possibly into downstream elements. As a result, a diffuser may be used in the inducer region to help remove a portion of either the cavitating flow or the vortices that can lead to cavitating flow in the fluid.

In addition to applying a diffuser to the field of pumps, the same application can be made for centrifugal, mixed flow, and axial compressors, blowers, and fans. The fundamental difference is that the cavitation that was suppressed or removed in the case of the pumps does not apply at all in the case of compressors, fans, and blowers which handle various gases. Cavitation only occurs in liquids. Nonetheless, it is possible to set up a leading edge vortex and other forms of inlet instability, which accompanies appropriate shaping of a vane leading edge. Such a vortex or other unstable zone may contain substantial energy that can negatively impact the operation of the respective equipment if not controlled.

As mentioned above, the use of a diffuser to reduce the velocity and increase the static pressure of a fluid passing through a system is well known when dealing with common inlet flows, but has not been previously used to swallow a tip vortex. Prior patented devices utilize various means in an attempt to address the problems related to inlet cavitation and the development of other flow instabilities within the inlet region. Allowing the flow to be pulled off through a cover slot or set of holes has been achieved in early patented work by Chapman and others (See Model 250-C301C28B Compressor Development by Dennis C. Chapman, General Motors Corporation). Allowing flow to be pulled off and then reentered upstream has also been accomplished through earlier patents by Jackson (U.S. Pat. No. 3,504,986, issued on Apr. 7, 1970), Cooper (U.S. Pat. No. 4,375,937, issued on Mar. 8, 1983), Meng (U.S. Pat. No. 4,708,584, issued on Nov. 24, 1987), and Edwards (U.S. Pat. No. 2,832,292, issued on Apr. 29, 1958).

Prior attempts at designing an effective diffuser for dealing with highly compromised flows such as a tip vortex have failed for various reasons. Previous diffuser designs are often focused on re-circulating flow rather than effectively diffusing flow. For example, flow is often bled off and routed through a tortuous flow path that dissipates the energy contained in the flow. By dissipating the energy in the fluid flow, the pressure contained in the fluid is reduced thereby reducing the effectiveness of any diffusing device present. In addition, diffusers of prior inventions often include vanes. Vaned diffusers have been known to cause additional instability in the flow field by causing distortion. In addition, vanes increase the difficulty of fabrication and installation of a diffuser. Still other diffuser designs fail to consider the particular characteristics of the flow field. For example, the length of other diffuser slots is often too short to cause enough static pressure to collapse and/or condense the vapor bubbles within a particular cavitating flow.

SUMMARY OF THE INVENTION

The present invention is a device for at least partially stabilizing an unstable fluid flow within a flow channel by capturing at least a portion of the unstable fluid within a vaneless diffuser. An additional aspect of the invention includes maintaining and harnessing a substantial portion of the energy contained in the fluid as it flows through the diffuser in order to take additional advantage of the fluid. An example of additional advantage includes discharging the diffuser effluent into the flow channel to help reduce instability in the flow channel. An additional aspect of the present invention is a diffuser design that is directly related to the particular fluid flow characteristics in which it will operate.

In one embodiment of the present invention, a device for at least partially stabilizing an unstable fluid flow within a flow channel includes an inducer or impeller residing at least partially within the flow channel, the inducer or impeller having rotatable blades for drawing flow into, or being driven by the flow in, the flow channel, the inducer or impeller rotatable about an axis, the flow channel defined by interior sidewalls of a housing, the housing at least partially surrounded by an inlet plenum, and the housing including an exit. The device also includes at least one diffuser slot having an inlet and an exit, the inlet in fluid communication with the flow channel, the diffuser slot(s) being substantially radial with respect to the axis. The device also includes at least one passage in fluid communication with the exit of the diffuser slot(s). The passage(s) may be in fluid communication with the inlet plenum, the housing exit exit, an area downstream of the housing exit, the flow channel, or a combination thereof. Finally, the diffuser slot(s) of the device generally have a radius ratio greater than or equal to 1.03 and are free of vanes.

In another embodiment of the present invention, a device includes multiple diffuser slots located along the flow channel. The flow is bled off of the flow channel at various points into the multiple diffuser slots. The flow in the slots is then treated similarly to that in the embodiment described above. It is contemplated within the present invention that any combination of diffuser slots may be utilized depending on the application.

In still another embodiment of the present invention, a device includes at least one diffuser slot located on either side of the housing exit vane and housing exit. Vortex or unstable flow is captured within the diffuser slot(s) and either discharged to the inlet plenum, back into the housing exit vane, or downstream of the housing exit.

In yet another embodiment of the present invention, any one of the devices having a diffuser slot as described above also includes a particle capture slot and particle trap. The particle capture slot is in fluid communication with the diffuser slot to capture any particles contained in the fluid as the fluid passes radially through the diffuser slot. The particles flow from the particle capture slot into a particle trap where they are contained.

Other features, utilities and advantages of various embodiments of the invention will be apparent from the following more particular description of embodiments of the invention as illustrated in the accompanying drawings.

BRIEF DESCRIPTION OF THE DRAWINGS

For the purpose of illustrating the invention, the drawings show a form of the invention that is presently preferred. However, it should be understood that the present invention is not limited to the precise arrangements and instrumentalities shown in the drawings, wherein.

DETAILED DESCRIPTION OF THE INVENTION

The present invention is directed to a device including a vaneless diffuser for reducing the velocity and increasing the static pressure of a fluid flowing through a system and for generally increasing the overall flow stability of a system. An example of the disclosed invention is depicted schematically in FIGS. 1–4, although it should be understood that the present invention is not limited to this (or any other) particular embodiment, but rather is intended to cover all devices that fairly fall within the broad scope of the appended claims.

The device of the present invention includes a vaneless diffuser for reducing the velocity and increasing the static pressure of a fluid flowing through a system. The vaneless diffuser of the present invention can be retrofitted to many open or closed impeller inducer pump configurations (i.e., with or without a shroud) or other equipment including bladed inducers or impellers (e.g., air-handling equipment). A substantially radial slot diffuser is placed around the inducer at a suitable position along the internal flow channel of the pump housing and provides an alternate path for the cavitated flow resulting from an unstable part-span (also called tip) vortex, which causes the instability of the impeller flow path. The inlet to the diffuser slot forms a substantially contiguous ring around the inducer and is followed by a channel of substantially radial design that provides a diffuser for the part-span vortex which naturally migrates radially away from the inducer axis due to its angular momentum. The substantially radial slot has a length that is selected to provide effective diffusion and to appropriately raise the static pressure.

In the case of a cavitating flow, which is trapped at the core of the vortex, the rise in static pressure causes the cavitating flow to be substantially collapsed and/or condensed from vapor back to liquid phase. Sufficient pressure recovery is achieved in the diffuser slot to return the fully condensed flow back into the inlet flow path via re-entry slots/holes and/or to the inlet plenum or downstream via return slots/holes. In the case of an unstable air flow, the diffuser slot helps to stabilize the flow by drawing at least a portion of the vortex or other unstable flow away from the inlet area thereby improving the upstream flow channel conditions.

Figure 1:
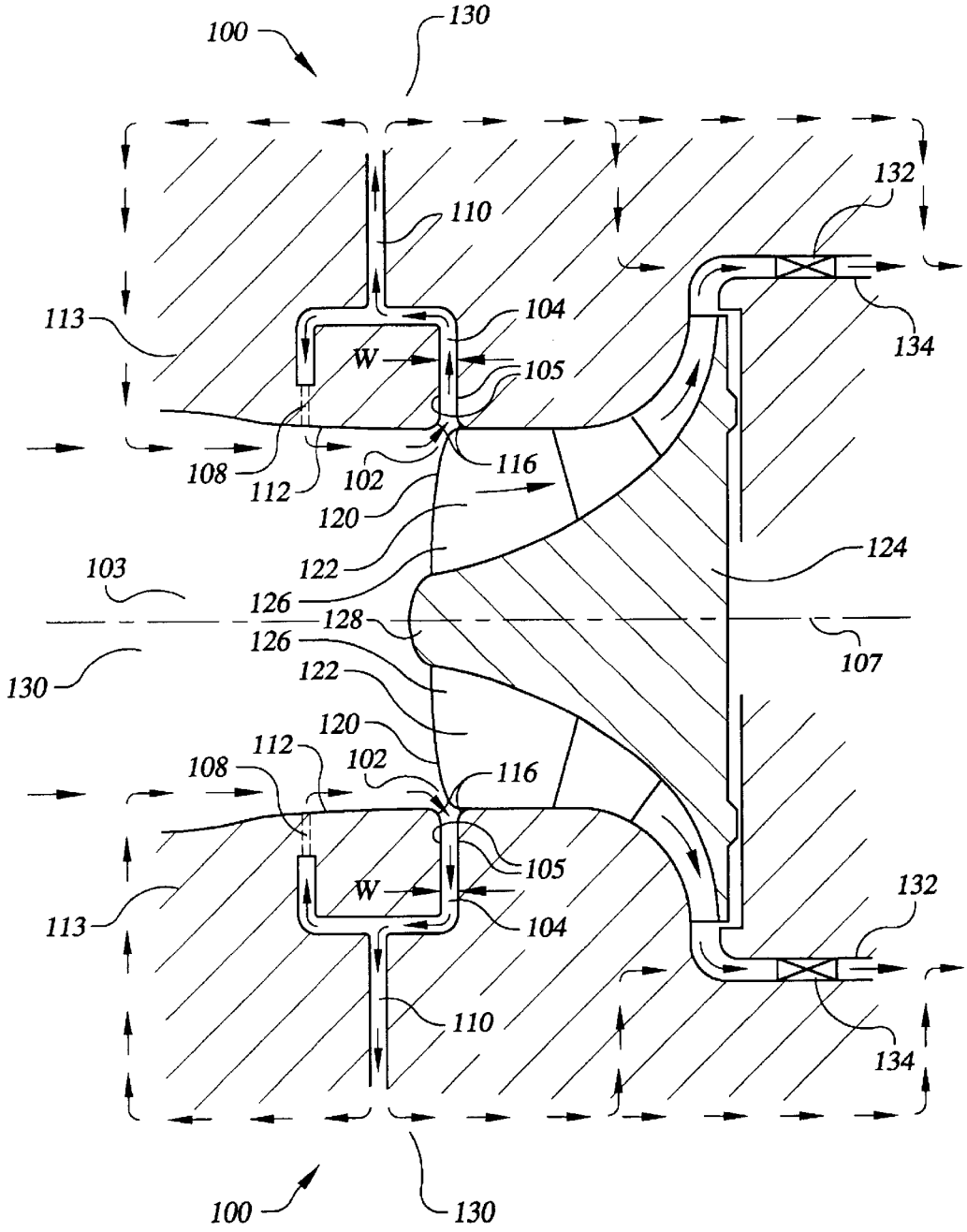
FIG. 1 is a side section view of one embodiment of the present invention.

In FIG. 1, diffuser 100 of the present invention generally includes an inlet 102, a diffuser slot 104, and one or more passages (passages include one or more re-entry slots 108 and/or one or more return slots 110). Inlet 102 is formed in the internal sidewalls 112 of a housing 113 and leads into diffuser slot 104. Diffuser slot 104 is typically vaneless and substantially radial with respect to a centerline axis 107 of a flow channel 103 and generally forms an annular ring that encircles flow channel 103. Diffuser slot 104 leads to at least one re-entry slot 108 and/or at least one return slot 110 which are also formed in sidewalls 112 of housing 113. Note that the term "channel" as contained herein may mean any conduit for fluid flow and includes any cross-sectional shape. In addition, the term "housing" generally refers to the body of any type of equipment that may contain a fluid channel. Finally, the term "fluid" may refer to any gas including air, liquid, vapor, or any combination thereof.

While diffuser slot 104 in particular preferably extends substantially radially relative to axis 107 of flow channel 103, the present invention encompasses divergence of up to about 65 degrees from a perfectly radial relationship with axis 107. Thus, the term "substantially radial" encompasses such divergence from a perfectly radial relationship. The degree of divergence from a perfectly radial relationship that is encompassed by the present invention is influenced, as those skilled in the art will appreciate, by factors such as orientation of slot inlet flow velocity vector and diffuser/plenum space constraints.

The edges 116 of inlet 102 to diffuser slot 104 are typically rounded to facilitate flow into the slot. However, inlets 102 having squared edges are also contemplated in the present invention. The walls 105 that define diffuser slot 104 are typically parallel as in FIG. 1. However, in other embodiments it is conceivable that the walls defining a diffuser slot may not be parallel (e.g., may include one or more pinch points along the slot).

Diffuser 100 of the present invention and more specifically the centerline of inlet 102 and diffuser slot 104 are located in flow channel 103 along housing sidewall 112 in relation to a leading edge 120 of an inducer blade 122 joined with an impeller 124. The one or more re-entry slots 108 typically form a pathway from diffuser slot 104 to an area of flow channel 103 immediately upstream of an inducer region 126 (i.e., the region formed by leading edge 120 of inducer blade 122 and a hub 128 of impeller 124).

Typically, any rotating, swirling, vortex, cavitating, or other unstable flow conditions are found adjacent leading edge 120 of inducer 122 within inducer region 126. Consequently, re-injection of diffused flow from re-entry slot 108 in the region of flow channel 103 immediately upstream of inducer region 126 will help reduce the amount of rotation in the area of re-injection thereby reducing upstream flow corruption from the unstable flow within inducer region 126.

The one or more return slots 110 typically form a pathway that leads from diffuser slot 104 to an area within an inlet plenum 130 outside of flow channel 103 and/or a pathway that leads from diffuser slot 104 to an exit 134 of flow channel 103 or to an area downstream of exit 134. Inlet plenum 130 is generally the area surrounding flow channel 103 and housing 113 from which fluid flow is drawn.

As illustrated in FIG. 1, diffuser slot 104 typically has a rectangular cross-section. In addition, one or more re-entry slots 108 and one or more return slots 110 also have substantially rectangular cross-sections. Although the term "slot" generally refers to a narrow passage, in embodiments of the present invention it is conceivable that the term slots may include passages with varying dimensions depending on the specific application. Accordingly, as used herein, the term "slot" may refer to passages of any size or cross-section.

As one skilled in the art will recognize, the specific dimensions and location of diffuser 100 of the present invention are selected based on the characteristics of the flow and the vortex within the flow (often influenced by inducer design) and the specific requirements for the diffuser (e.g., controlling or stabilizing unstable flow, and/or extending the cavitation performance of the pump, etc.). Other variables that impact the specific dimensions of diffuser 100 include the dimensions of flow channel 103, impeller 124, and inducer 122 as well as the flow rate parameters.

Although many variables may impact the location and specific dimensions of diffuser 100, some general rules for determining 1) the width (W) of diffuser slot 104 and 2) the location of the centerline of diffuser slot 104 with respect to leading edge 120 of inducer 122 for embodiments of the present invention do exist. The width (W) is related to the vane or blade height of inducer 122 (or other bladed/vaned mechanism) at inlet 102 of diffuser slot 104.

Specifically, W=(0.05 to 0.50)×(blade or vane height of inducer 122 at inlet 102). In one embodiment, W=(0.03 to 0.20)×(blade or vane height of inducer 122 at inlet 102). In general, the width should be small enough so as not to bleed an excessive amount of the flow from flow channel 103. In the embodiments of the present invention contained herein, the loss in efficiency due to bleeding the flow is generally negligible due to the increase in overall equipment performance. The blade or vane height is the length of the blade or vane as measured from the surface of the impeller radially outward to the edge of the blade adjacent the sidewall of the housing.

The location of the centerline of diffuser slot 104 is also related to the size of the vane or blade of diffuser. The centerline of inlet 102 should typically be located along sidewalls 112 of housing 113 with respect to the span length of leading edge blade 122 and the location of leading edge 120 itself within flow channel 103. More specifically, inlet 102 should be located a distance of up to ±70% of the blade or vane height of inducer 122 downstream or upstream of leading edge 120, as measured parallel to axis 107. A positive number means inlet 102 is located downstream of leading edge 120 and a negative number means inlet 102 is located upstream of leading edge 120. Again, the blade or vane height is the length of the blade or vane as measured from the surface of the impeller radially outward to the edge of the blade adjacent the sidewall of the housing.

In addition to the design parameters delineated above, additional design parameters have also been developed in the course of refining diffuser 100 and other embodiments herein. First, in at least one embodiment of the present invention, it has been determined that diffuser slot 104 should typically have a radius ratio of greater than or equal to 1.03. The radius ratio is the radial extent at the exit of diffuser slot 104, divided by the radius to inlet 102. The radial extent at the exit of diffuser slot 104 is typically the distance from axis 107 to the termination of diffuser slot 104. The radius to inlet 102 is typically the distance from axis 107 to inlet 102. In another embodiment, the radius ratio ranged from about 1.03 to about 10. Substantially all slots included in the present invention will have a radius ratio according to the above.

Second, in at least one embodiment of the present invention, it has been determined that the flow entering diffuser slot 104 from flow channel 103 should typically range from about ½–2% to about 5–15% of the overall flow in flow channel 103 at the principal operating or design conditions. Inlet 102 and diffuser slot 104 are sized to achieve fluid flow within this range.

Finally, it is preferable that no vanes be incorporated within diffuser slot 104. Diffusers having vanes have been found to increase difficulty of fabrication, increase difficulty of installation, increase inlet blockage and noise, and if poorly done, may increase distortion. Additionally, diffuser vanes would serve to break up the tip vortex rather than allow its full energy to be recovered through the unobstructed flow process of a vaneless diffuser. Likewise, other objects near inlet 102 such as labyrinth seals, other seals, bends, or other distortions to the passage would have the same adverse impact.

As mentioned above, the specific parameters related to the application requirements impact the specific dimensions and placement of diffuser 100. In one embodiment of the present invention, designed for use in turbo pump applications with very high suction specific speed requirements, the dimensions of the inlet control aspects of diffuser 100 are as follows: a radial extent to the exit of diffuser slot 104 of 2.2", a distance from the diffuser slot 104 centerline to leading edge 120 of inducer 122 of 0.3", a diffuser slot 104 width of 0.2", and an inlet 102 radius of 1.4". Again, one skilled in the art will recognize that these dimensions will vary depending on the specific pumping application and the changes in the related parameters. However, the design parameters related to the sizing and location of the diffuser slot generally apply regardless of the specific application and for all embodiments described herein.

With reference to the arrows in FIG. 1, the operation of diffuser 100 will now be discussed. Flow from inlet plenum 130 enters flow channel 103 and flows toward hub 128 of impeller 124. The flow enters inlet 102 of diffuser 100 and flows radially outward within diffuser slot 104. In the embodiment illustrated in FIG. 1, diffuser 100 includes both one or more re-entry slots 108 and one or more return slots 110. Flow from diffuser slot 104 next flows toward both re-entry slot 108 and return slot 110. A portion of the flow from diffuser slot 104 flows into return slot 110 and radially outward to inlet plenum 130. The remaining portion of flow from diffuser slot 104 flows into re-entry slot 108. The flow exits re-entry slot 108 at an area within flow channel 103 directly upstream of inducer region 126 defined by inducer 122, impeller hub 128, and inducer leading edge 120. The flow exiting re-entry slot 108 mixes with the flow entering flow channel 103 from inlet plenum 130 and continues onward toward hub 128 of impeller 124. A substantial portion of the flow in flow channel 103 flows past inlet 102 of diffuser 100 and into inducer region 126. This flow continues along the blades or vanes of inducer 120 and toward exit 134 of housing 113. The flow exiting housing 113 typically passes through a vane 132 within housing exit 134. Of course, in other embodiments, device 100 may include one or more re-entry slots 108 and no plenum return and/or exit slots 110 or vice versa.

As mentioned above, inlet 102 to diffuser slot 104 forms a substantially contiguous ring around inducer region 126 of channel 103 and is followed by a slot or channel of substantially radial design (diffuser slot 104) that provides a diffuser for the part-span vortex or other unstable flow which naturally migrates radially away from axis 107 due to its angular momentum. Substantially radial diffuser slot 104 has a length that is selected to provide effective diffusion and to appropriately raise the static pressure. By raising the static pressure, two-phase fluids at least partially containing vapor are collapsed and/or condensed back into single-phase fluids containing liquid. The higher static pressure causes the vapor bubbles in the vapor to compress. By including a substantially radial design and a clean inlet design (i.e., not tortuous path), the energy in the fluid drawn into diffuser slot 104 is conserved thereby increasing the efficiency of diffusion. Such a design allows for efficient diffusion and the ability take additional advantage of the fluid. An example of additional advantage includes discharging the diffuser effluent into the flow channel to help reduce instability in the flow channel.

Figure 2:
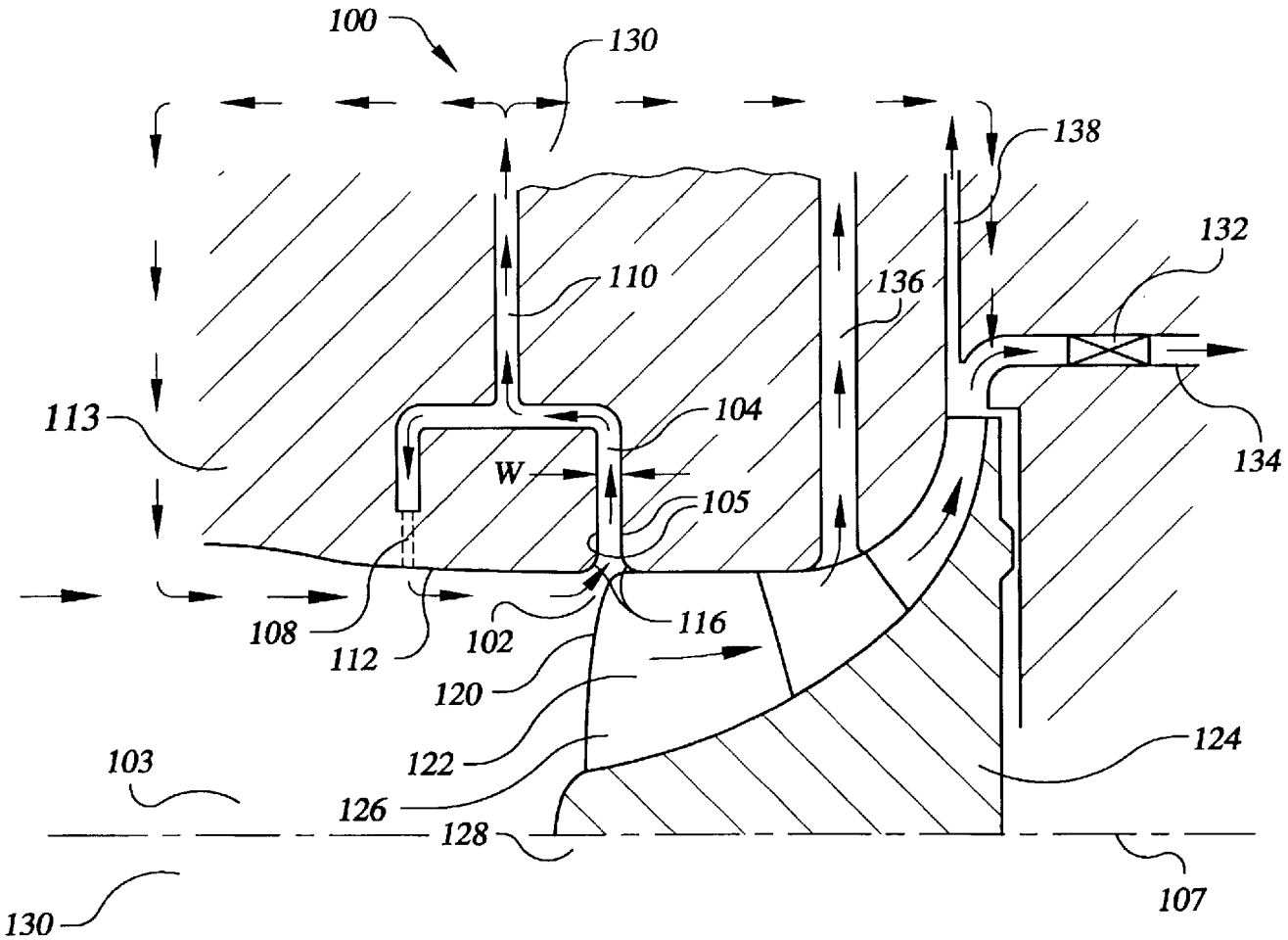
FIG. 2 is a side section view of another embodiment of the present invention.
Figure 3A:
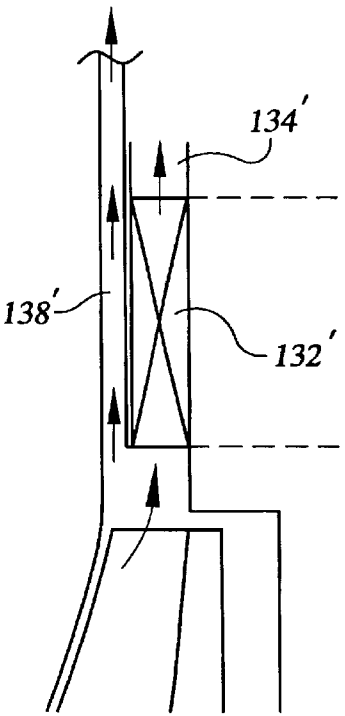
FIGS. 3*a*–3*d* are side section views of various embodiments of the present invention.
Figure 3B:
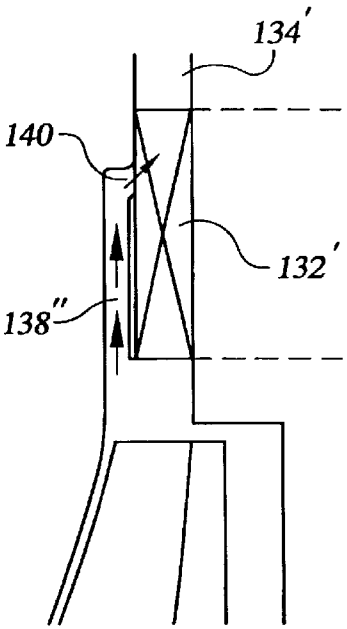
Figure 3C:
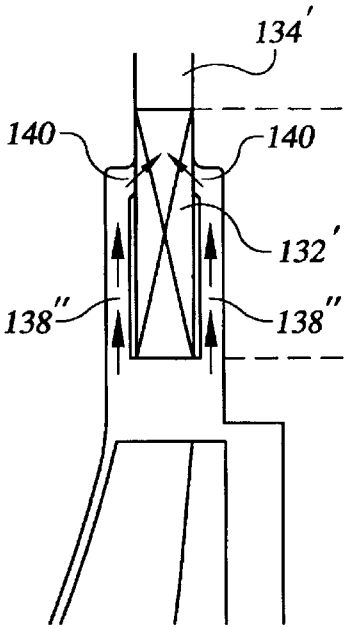
Figure 3D:
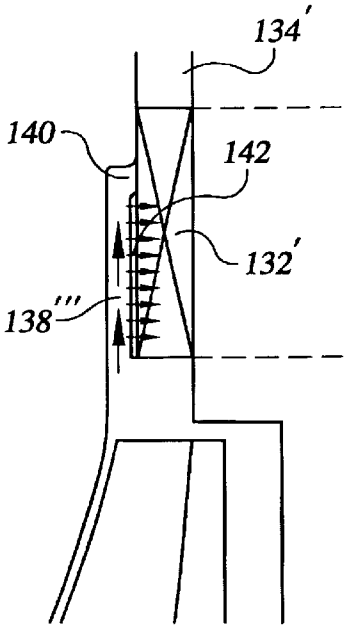
Figure 4:
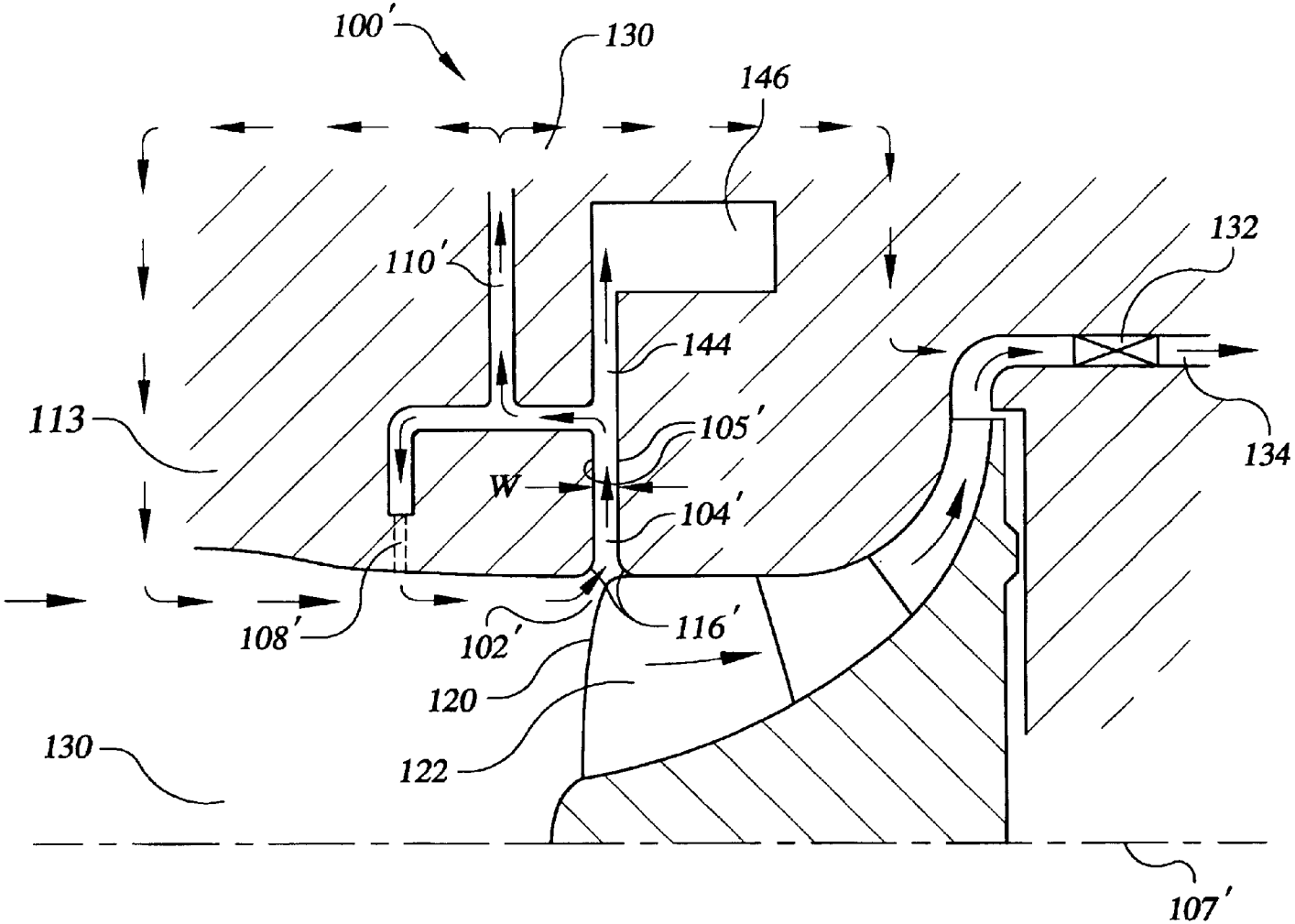
FIG. 4 is a side section view of yet another embodiment of the present invention.

FIGS. 2–4 illustrate alternative embodiments of the diffuser. The embodiment in FIG. 2 includes aspects that are identical to the embodiment in FIG. 1. Accordingly, some of the element numbers in FIG. 2 are identical to the element numbers in FIG. 1 for identical elements. However, in FIG. 2 multiple diffuser slots 104, 136, and 138 are present within sidewalls 112 of housing 113. Diffuser slot 104 is located adjacent leading edge 120 of inducer 122, diffuser slot 136 is located within impeller or inducer region 126 between leading edge 120 and housing exit 134, and diffuser slot 138 is located adjacent housing exit 134. Although not discussed with respect to FIGS. 2–4 below, the embodiments illustrated in FIGS. 2–4 generally include radius ratios as in FIG. 1 and are free of vanes as in FIG. 1.

Multiple diffuser slots may be used to bleed portions of flow channel 103 along various points within the channel. In addition to the reasons for bleeding flow adjacent leading edge 120 of diffuser 122 in the case of diffuser slot 104, it may also be desirable to bleed the flow at other points downstream from leading edge 120 of inducer 122. In FIG. 2, additional diffuser slots 136, 138 are located downstream of diffuser slot 104 and leading edge 120. In the case of diffuser slot 136, where a shrouded impeller is used, diffuser slot 136 may be used to capture any shroud leakage flow. As for the diffuser slot 138, it may be desirable to attempt to bleed off any remaining unstable flow such as impeller shroud leakage or system backflow prior to discharging the flow through housing exit 134. It is contemplated that diffuser slots 136, 138 will be configured in a manner similar to that of diffuser slot 104 and diffuser 100. Although FIG. 2 illustrates the presence of three diffuser slots 104, 136, 138, in at least one embodiment, there are only two diffuser slots. Other embodiments may include four or more diffuser slots. Embodiments including multiple diffuser slots may include any combination of slots or single slots in any locations illustrated in FIG. 2.

The flow through the embodiment illustrated in FIG. 2 is very similar to that in the embodiment illustrated in FIG. 1. However, as the flow continues within flow channel 103 past diffuser slot 104, a portion of the flow may also be bled off into diffuser slot 136. As with diffuser slot 104, the flow entering diffuser slot 136 may be returned to flow channel 103 in an area of the flow channel upstream of diffuser slot 136. The flow in diffuser slot 136 may also be returned to inlet plenum 130 or discharged to an area downstream of housing exit 134. As in the case of both diffuser slot 104 and diffuser slot 136, a portion of the flow will bypass both diffuser slots 104 and 136 and flow toward exit 134 of flow channel 103. Prior to exiting flow channel 103 through exit 134, an additional portion of the flow may be bled off into diffuser slot 138. The flow entering diffuser slot 138 may be treated similarly to the flow bled off in diffuser slots 104 and 136.

FIGS. 3*a*–3*d* illustrate alternative embodiments of the diffuser slot of the present invention. In particular, FIGS. 3*a*–3*d* are related to embodiments where at least one diffuser slot is located adjacent the exit of the housing. Because the housing exit configuration illustrated in FIGS. 3*a*–3*d* is similar to those illustrated in FIGS. 1–2, any elements in FIGS. 3*a*–3*d* that are similar to elements in FIGS. 1–2 will be noted by the use of a similar element number having a prime symbol.

In FIG. 3*a*, a portion of the flow exiting the housing is bled off into diffuser slot 138'thereby by-passing exit 134'. By locating diffuser slot 138' on the outside of housing exit vane 132', at least a portion of any vortex or other unstable flow will be captured by diffuser slot 138'. Vortex or other unstable flows are generally flows that are not collateral with the direction of the flow channel and the bulk of the flow field. The unstable flow captured in diffuser slot 138' is then discharged into a diffuser configuration similar to any one previously mentioned herein, directly to the inlet plenum, or into an area downstream of housing exit 134'.

In FIG. 3*b*, diffuser slot 138' resides to the side of the housing exit vane 132'. However, unlike FIG. 3*a*, the unstable flow captured in diffuser slot 138' is returned to housing exit vane 132' through exit return slot 140. The flow mixes with the flow exiting the housing through housing exit vane 132' and housing exit 134'. The by-pass flow from slot 138' may also be injected into any corners of an exit channel to suppress corner stall.

The embodiment illustrated in FIG. 3*c* is almost identical to that in FIG. 3*b* with the exception that a diffuser slot 138" is located on both sides of housing exit 132' through exit return slots 140. At least a portion of any unstable flow in the area to the sides of the housing exit vane will be captured in diffuser slots 138" and returned downstream within housing exit vane 132'.

Structurally, the embodiment illustrated in FIG. 3*d* is similar to that illustrated in FIG. 3*b*. However, the sidewall of diffuser slot 138'" that is in common with sidewall of exit housing vane 132' includes exit return holes 142. Any unstable flow captured within diffuser slot 138'" may return to housing exit vane 132' through exit return holes 142 and/or through exit return slot 140. In one embodiment, the configuration in FIG. 3*d* allows flow to be introduced into a hollow vane and exit through a cascade exit to achieve a blown flap control device.

FIG. 4 illustrates another alternative embodiment of the present invention. As in FIG. 3, any elements in FIG. 4 that are similar to elements in other embodiments contained herein will be noted with a prime next to the element number. In FIG. 4, diffuser 100' is virtually identical to diffuser 100 illustrated in FIG. 1. However, diffuser 100' includes an additional slot. Particle capture slot 144 is used to capture particles (either solid or, in the pump case, entraining air or other non-condensing gases) from the flow exiting diffuser slot 104' and lead them to a particle trap 146.

Particle capture slot 144 is typically an elongation of diffuser slot 104'. Particle slot 144 terminates in a generally rectangular cross-sectional area groove also known as particle trap 146. Although not illustrated herein, additional passages or conduits that are in fluid communication with particle trap 146 may be included to allow the trap to be emptied as necessary. The remainder of diffuser 100' is again virtually identical to diffuser 100 in FIG. 1.

In FIG. 4, flow enters flow channel 103 from inlet plenum 130 and is drawn toward impeller hub 128 by rotating impeller 124 and inducer 122. At least a portion of the unstable flow enters inlet 102' and flows radially outward from axis 107' within diffuser slot 104'. Due to centrifugal forces, any particles within the flow will continue radially outward from diffuser slot 104' into particle capture slot 144 and finally into particle trap 146. The remainder of the flow will flow from diffuser slot 104' into at least one of one or more reentry slots 108' and one or more return slots 110'. The flow exiting slots 108' and 110' will continue in a manner similar to the flow in diffuser 100, as illustrated in FIG. 1 and described in detail above.

Although the components that make up diffuser 100 of the present invention are generally described as slots herein, it is foreseeable that in other embodiments of the present invention various slots may be replaced by a plurality of holes or other orifices, a plurality of corresponding chambers, and/or a plurality of any other type of conduit (i.e., pipes, channels, grooves, etc.).

Although the illustrations contained herein are of an open inducer/impeller, it is contemplated that embodiments of the present invention may be used with either closed or open (i.e., shrouded or unshrouded) impeller/inducer configurations.

In another embodiment, an active diffuser slot is included instead of a passive diffuser slot. In the embodiments described above, the diffuser slot is passive in that it remains open at all times. An active diffuser slot may be configured to remain in a default closed position and only open when the pressure in the inducer region drops to a prescribed level.

In still another embodiment, a diffuser slot of the present invention may also be incorporated into the design of a hydroturbine. Hydroturbines work similar to pumps and compressors. However, the flow usually passes through the impeller in the reverse direction and work is extracted from the flow as opposed to work being done on the flow as in the case of a pump or impeller. For hydroturbines, all types of vortices are possible. By using a diffuser of the present invention to allow shroud bleed at the exit (or exducer) of the turbine, analogous to the inlet of radial pumps, it is likely that the overall performance of a hydroturbine will be improved.

The flow stabilizing device of the present invention including a novel diffuser slot offers advantages over prior art devices. By creating a diffuser slot having a clean inlet, a non-tortuous path, and a design related to the specific flow conditions, the device of the present invention maximizes the amount of energy in the fluid that is captured/recovered. In turn, this allows for a maximum pressure recovery (the change of kinetic energy to a static pressure rise). Maximizing pressure recovery offers at least two benefits to the overall operation of a system. First, for a cavitating flow, a greater pressure recovery helps ensure that substantially all two-phase fluid is converted back to single-fluid by collapsing and/or condensing any vapor bubbles in the fluid as it flows through the diffuser slot. Second, in a non-cavitating flow or in the case of vapor flow, maximizing the energy recovered in the fluid helps to ensure that a sufficient static pressure will exist to do gain additional benefits from the fluid. Additional benefits include re-injecting the fluid upstream or elsewhere in the system to help moderate the flow condition in the area of the re-injection. Moderation is achieved by either removing vortices in the flow to prevent corruption of upstream or downstream flow or by re-injecting to help reduce fluid rotation in the area of re-injection. Improving the upstream conditions of the fluid flow may allow the equipment and the system overall to operate more efficiently.

While the present invention has been described in connection with a preferred embodiment, it will be understood that it is not so limited. On the contrary, it is intended to cover all alternatives, modifications and equivalents as may be included within the spirit and scope of the invention as defined in the appended claims.

What is claimed is:

1. A device for at least partially stabilizing an unstable fluid flow within a flow channel, the device including an inducer or impeller residing at least partially within the flow channel, the inducer or impeller having rotatable blades for drawing the flow into, or being driven by the flow in, the flow channel, the inducer or impeller rotatable about an axis, the flow channel defined by interior sidewalls of a housing, the housing at least partially surrounded by an inlet plenum, the housing including an exit, said device comprising:

a) at least one diffuser slot, said at least one diffuser slot including an inlet and an exit, said inlet in fluid communication with the flow channel, said at least one diffuser slot being substantially radial with respect to the axis; and b) at least one passage in fluid communication with said exit of said at least one diffuser slot and said at least one passage in fluid communication with at least one of the inlet plenum, the housing exit, an area downstream of the housing exit, and the flow channel;

wherein said at least one diffuser slot has a radius ratio greater than or equal to 1.03, said radius ratio selected so that the device causes a two-phase fluid to collapse or condense into a substantially single-phase fluid, and said at least one diffuser slot is free of vanes.

2. A device as in claim 1, wherein said at least one passage is a re-entry slot, a return slot, or a combination thereof.

3. A device as in claim 1, wherein said at least one diffuser slot has a radius ratio of less than 10.

4. A device as in claim 1, wherein said at least one diffuser slot has a radius ratio of about 1.07 to about 2.00.

5. A device as in claim 1, wherein said at least one diffuser slot has a width of about (0.05 to 0.50)×(the radial height of said impeller or inducer blades at said at least one diffuser slot inlet).

6. A device as in claim 1, wherein the inducer or impeller rotatable blades have a leading edge and said at least one diffuser slot inlet has a longitudinal center-line that intersects the flow channel at a point along the sidewalls, the distance from said point to the leading edge being up to 70% of the radial height of said impeller or inducer blades.

7. A device as in claim 1, wherein said at least one diffuser slot is sized so that the flow through said at least one diffuser slot is from about ½%–15% of an overall flow through said flow channel at the best operating point within the channel.

8. A device as in claim 1, wherein said at least one diffuser slot is positioned to capture a part-span vortex in the fluid thereby at least partially collapsing the vortex.

9. A device as in claim 1, wherein said at least one diffuser slot does not have a constant width.

10. A device as in claim 1, wherein the fluid flow is under a static pressure and said at least one diffuser slot is configured such that the static pressure in the fluid flow is sufficient to move the fluid flow from said at least one diffuser slot to said at least one passage.

11. A device as in claim 1, wherein said at least one diffuser slot is oriented so that it is no more than 65 degrees from radial with respect to said axis.

12. A device as in claim 1, wherein said at least one diffuser slot is oriented so that it is no more than 10 degrees from radial with respect to said axis.

13. A device as in claim 1, wherein said device includes at least two diffuser slots.

14. A device as in claim 13, wherein at least one of said diffuser slots is located adjacent a leading edge of the blades.

15. A device as in claim 13, wherein at least one of said diffuser slots is located adjacent the housing exit.

16. A device as in claim 13, wherein at least one of said diffuser slots is located adjacent the blades downstream of a leading edge of said blades.

17. A device as in claim 1, further comprising:

a) a particle capture slot in fluid communication with said at least one diffuser slot; and b) a particle trap in fluid communication with said particle capture slot.

18. A device as in claim 1, wherein the device includes a means for maintaining or increasing the static pressure in the fluid flow as the fluid flow flows through the device.

19. A device as in claim 1, wherein the device includes a means for directing fluid from said at least one diffuser slot to multiple areas within or outside of the housing.

20. A device for at least partially stabilizing an unstable fluid flow within a flow channel, the device including an inducer or impeller residing at least partially within the flow channel, the inducer or impeller having rotatable blades for drawing the flow into, or being driven by the flow in, the flow channel, the inducer or impeller rotatable about an axis, the flow channel defined by interior sidewalls of a housing, the housing at least partially surrounded by an inlet plenum, the housing including an exit, said device comprising:

a) at least one diffuser slot, said at least one diffuser slot including an inlet and an exit, said inlet in fluid communication with the flow channel, said at least one diffuser slot being substantially radial with respect to the axis;

b) a re-entry slot in fluid communication with said at least one diffuser slot and the flow channel; and c) a return slot in fluid communication with said at least one diffuser slot and at least one of (i) the inlet plenum and (ii) the housing exit;

wherein said at least one diffuser slot is free of vanes and said at least one diffuser slot has a width of about (0.05 to 0.50)×(the radial height of said impeller or inducer blades at said at least one diffuser slot inlet).

21. A device as in claim 20, wherein said at least one diffuser slot has a radius ratio greater than 1.03.

22. A device as in claim 20, wherein said at least one diffuser slot has a radius ratio of about 1.07 to about 2.00.

23. A device as in claim 19, wherein the inducer or impeller rotatable blades have a leading edge and said at least one diffuser slot inlet has a longitudinal center-line that intersects the flow channel at a point along the sidewalls, the distance from said point to the leading edge being up to 70% of the radial height of said impeller or inducer blades.

24. A device as in claim 19, wherein said at least one diffuser slot is sized so that the flow through said at least one diffuser slot is from about ½%–15% of an overall flow through said flow channel at the best operating point within the channel.

25. A device for at least partially stabilizing an unstable fluid flow within a flow channel, the device including an inducer or impeller residing at least partially within the flow channel, the inducer or impeller having rotatable blades for drawing the flow into, or being driven by the flow in, the flow channel, the inducer or impeller rotatable about an axis, the flow channel defined by interior sidewalls of a housing, the housing at least partially surrounded by an inlet plenum, the housing including an exit, said device comprising:

a) at least two diffuser slots, said at least two diffuser slots including an inlet and an exit, said inlet in fluid communication with the flow channel, said at least two diffuser slots being substantially radial with respect to the axis; and b) at least one passage in fluid communication with said exit of said at least two diffuser slots and;

wherein said at least one passage is in fluid communication with at least one of the inlet plenum, the housing exit, an area downstream of the housing exit, and the flow channel and each of said at least two diffuser slots is free of vanes and each of said at least two diffuser slots has a radius ratio greater than 1.03.

26. A device as in claim 25, wherein said at least one diffuser slot has a radius ratio of about 1.07 to about 2.00.

27. A device for at least partially stabilizing an unstable fluid flow within a flow channel, the device including an inducer or impeller residing at least partially within the flow channel, the inducer or impeller having rotatable blades for drawing the flow into, or being driven by the flow in, the flow channel, the inducer or impeller rotatable about an axis, the flow channel defined by interior sidewalls of a housing, the housing at least partially surrounded by an inlet plenum, the housing including an exit, said device comprising:

a) at least one diffuser slot, said at least one diffuser slot including an inlet and an exit, said inlet in fluid communication with the flow channel, said at least one diffuser slot being substantially radial with respect to the axis; and b) at least one passage in fluid communication with said exit of said at least one diffuser slot and said at least one passage in fluid communication with at least one of the inlet plenum, the housing exit, an area downstream of the housing exit, and the flow channel;

wherein said at least one diffuser slot has a radius ratio greater than or equal to 1.03, at least one of said at least one diffuser slots is adjacent the housing exit, and said at least one diffuser slot is free of vanes.

28. A device as in claim 27, wherein said at least one passage adjacent the housing exit includes a return slot in fluid communication with the housing exit.

29. A device as in claim 27, wherein said at least one passage adjacent the housing exit is in fluid communication with the inlet plenum.

30. A device for at least partially stabilizing an unstable fluid flow within a flow channel, the device including an inducer or impeller residing at least partially within the flow channel, the inducer or impeller having rotatable blades for drawing the flow into, or being driven by the flow in, the flow channel, the inducer or impeller rotatable about an axis, the flow channel defined by interior sidewalls of a housing, the housing at least partially surrounded by an inlet plenum, the housing including an exit, said device comprising:

a) at least one diffuser slot, said at least one diffuser slot including an inlet and an exit, said inlet in fluid communication with the flow channel, said at least one diffuser slot being substantially radial with respect to the axis;

b) at least one passage in fluid communication with said exit of said at least one diffuser slot and said at least one passage in fluid communication with at least one of the inlet plenum, the housing exit, an area downstream of the housing exit, and the flow channel;

c) a particle capture slot in fluid communication with said at least one diffuser slot; and d) a particle trap in fluid communication with said particle capture slot;

wherein said at least one diffuser slot is free of vanes.

31. A device as in claim 30, wherein said at least one diffuser slot has a radius ratio greater than 1.03.

32. A device as in claim 30, wherein said at least one diffuser slot has a radius ratio of about 1.07 to about 2.00.

33. A device as in claim 30, wherein said at least one diffuser slot has a width of about (0.05 to 0.50)×(the radial height of said impeller or inducer blades at said at least one diffuser slot inlet).

34. A device as in claim 30, wherein the inducer or impeller rotatable blades have a leading edge said at least one diffuser slot inlet has a longitudinal center-line that intersects the flow channel at a point along the sidewalls, the distance from said point to leading edge being up to 70% of the radial height of said impeller or inducer blades.

35. A device as in claim 30, wherein said at least one diffuser slot is sized so that the flow through said at least one diffuser slot is from about ½%–15% of an overall flow through said flow channel at the best operating point within the channel.

36. A device for at least partially stabilizing an unstable fluid flow within a flow channel, the device including an inducer or impeller residing at least partially within the flow channel, the inducer or impeller having rotatable blades for drawing the flow into, or being driven by the flow in, the flow channel, the inducer or impeller blades having a leading edge, the inducer or impeller rotatable about an axis, the flow channel defined by interior sidewalls of a housing, the housing at least partially surrounded by an inlet plenum, the housing including an exit, said device comprising:

a) at least two diffuser slots, said at least two diffuser slots including an inlet and an exit, said inlet in fluid communication with the flow channel, said at least two diffuser slots being substantially radial with respect to the axis; and b) at least one passage in fluid communication with said exit of said at least two diffuser slots and;

wherein said at least one passage is in fluid communication with at least one of the inlet plenum, the housing exit, an area downstream of the housing exit, and the flow channel and each of said at least two diffuser slots is free of vanes and each of said at least two diffuser slots has a width of about (0.05 to 0.50)×(the radial height of said impeller or inducer blades at said at least one diffuser slot inlet).

37. A device for at least partially stabilizing an unstable fluid flow within a flow channel, the device including an inducer or impeller residing at least partially within the flow channel, the inducer or impeller having rotatable blades for drawing the flow into, or being driven by the flow in, the flow channel, the inducer or impeller blades having a leading edge, the inducer or impeller rotatable about an axis, the flow channel defined by interior sidewalls of a housing, the housing at least partially surrounded by an inlet plenum, the housing including an exit, said device comprising:

a) at least two diffuser slots, said at least two diffuser slots including an inlet and an exit, said inlet in fluid communication with the flow channel, said at least two diffuser slots being substantially radial with respect to the axis; and b) at least one passage in fluid communication with said exit of said at least two diffuser slots and;

wherein said at least one passage is in fluid communication with at least one of the inlet plenum, the housing exit, an area downstream of the housing exit, and the flow channel and each of said at least two diffuser slots is free of vanes and each of said at least two diffuser slots has a longitudinal center-line that intersects the flow channel at a point along the sidewalls, the distance from said point to the leading edge being up to 7000 of the radial height of the impeller or inducer blades.

38. A device for at least partially stabilizing an unstable fluid flow within a flow channel, the device including an inducer or impeller residing at least partially within the flow channel, the inducer or impeller having rotatable blades for drawing the flow into, or being driven by the flow in, the flow channel, the inducer or impeller blades having a leading edge, the inducer or impeller rotatable about an axis, the flow channel defined by interior sidewalls of a housing, the housing at least partially surrounded by an inlet plenum, the housing including an exit, said device comprising:

a) at least two diffuser slots, said at least two diffuser slots including an inlet and an exit, said inlet in fluid communication with the flow channel, said at least two diffuser slots being substantially radial with respect to the axis; and b) at least one passage in fluid communication with said exit of said at least two diffuser slots and;

wherein said at least one passage is in fluid communication with at least one of the inlet plenum, the housing exit, an area downstream of the housing exit, and the flow channel and each of said at least two diffuser slots is sized so that the flow through each of said at least two diffuser slots is from about ½%–15% of an overall flow through the flow channel at the best operating point within the channel.

* * * * *

UNITED STATES PATENT AND TRADEMARK OFFICE

CERTIFICATE OF CORRECTION

PATENT NO. : 6,699,008 B2
APPLICATION NO. : 10/172886
DATED : March 2, 2004
INVENTOR(S) : David Japikse It is certified that error appears in the above-identified patent and that said Letters Patent is hereby corrected as shown below:

In claim 37, column 14, line 20, delete “7000” and insert -- 70% -- therefor.

Signed and Sealed this

Twenty-ninth Day of May, 2007

JON W. DUDAS
*Director of the United States Patent and Trademark Office*